US009890915B2

(12) United States Patent
Lai

(10) Patent No.: US 9,890,915 B2
(45) Date of Patent: Feb. 13, 2018

(54) WATER CURTAIN SIMULATED CANDLE LAMP

(71) Applicant: Wen-Cheng Lai, Taoyuan County (TW)

(72) Inventor: Wen-Cheng Lai, Taoyuan County (TW)

( * ) Notice: Subject to any disclaimer, the term of this patent is extended or adjusted under 35 U.S.C. 154(b) by 38 days.

(21) Appl. No.: 15/009,439

(22) Filed: Jan. 28, 2016

(65) Prior Publication Data

US 2016/0298815 A1 Oct. 13, 2016

(30) Foreign Application Priority Data

Apr. 13, 2015 (CN) ..... 2015 2 0220334 U

(51) Int. Cl.

| | |
|---|---|
| ***F21V 33/00*** | (2006.01) |
| ***F21S 10/00*** | (2006.01) |
| ***F21S 10/04*** | (2006.01) |
| *F21W 121/00* | (2006.01) |
| *F21Y 115/10* | (2016.01) |

(52) U.S. Cl.

CPC ..... *F21S 10/002* (2013.01); *F21S 10/04* (2013.01); *F21W 2121/00* (2013.01); *F21Y 2115/10* (2016.08)

(58) Field of Classification Search

CPC ..... F21S 10/002; F21S 10/04; F21Y 2115/10; F21W 2121/00

USPC ..... 362/96

See application file for complete search history.

(56) References Cited

U.S. PATENT DOCUMENTS

2013/0126633 A1* 5/2013 Powell ..... B05B 17/00 239/18

2013/0223043 A1* 8/2013 Ray ..... F21V 33/00 362/96

* cited by examiner

*Primary Examiner* — Elmito Breval

*Assistant Examiner* — Jessica M Apenteng

(74) *Attorney, Agent, or Firm* — Rabin & Berdo, P.C.

(57) ABSTRACT

A water curtain simulated candle lamp, which is mainly provided to achieve the dynamic effect of simulating candle burning by using water curtain projection, including a base body, a cover body, a spraying device, a light source and a floating wick. Wherein, a water container with an upper opening is set on the base body, the cover body including a concave upper surface is used to cover the water container, and a spacing hole is set on its concave end; the spraying device set inside the water container includes a pump and a spray pipe, which is used to spray a water curtain simulating flame shape from the spacing hole; the light source is used to light up the sprayed water curtain, the floating wick set inside the spray pipe is provided to move up and down with water flow to form a wick of simulating candle lamp.

11 Claims, 7 Drawing Sheets

WATER CURTAIN SIMULATED CANDLE LAMP

BACKGROUND OF THE INVENTION

1. Field of the Invention

The invention relates to an electric lamp and, more particularly, to a water curtain simulated candle lamp using water curtain projection to simulate flame dynamic effect.

2. Description of Related Art

In today's society, traditional lighting tools, such as candles and oil lamps, have already replaced by various electric lamp. But in some particular occasions or special situations, candles and oil lamps that still have traditional meanings and special visual effects could not be replaced by lighting tools used in today's daily life. For example, incense and candles are often used in worship of deities and ancestors, shaking candle fire may be regarded as memory for ancestors and expectations for future generations. Or in some occasions needing specific atmosphere, shaking effect of candle fire may also cause different visual perception. However, traditional lamps, such as candles, oil lamps, have security concerns due to flame. Combustible objects around may be easily fired when a traditional lamp is upset by wind or human factors. Thus, simulated candle lamps have been developed.

In the market, most simulated fire electric lamps simulate flame perception by lightening up a flame-shaped plate body, more than this, electric drive devices such as motors are used for driving objects to move or shake to achieve the dynamic effect of simulating fire.

Those simulated candle electric lamps are provided to replace lighting objects such as candles and oil lamps, and they may be used as nice decorative lighting with beautiful design of appearance. More functional designs may highly improve the quality of life and it is a subject at the present stage, the inventor finally completes the present invention after numerous improvements.

SUMMARY OF THE INVENTION

The object of the present invention is to provide a water curtain simulated candle lamp, which simulates visual perception of dynamic candle lamp by using water curtain projection.

Another object of the present invention is to provide with incense, suitable perfume source added into water may gradually volatile in the air when water curtain is sprayed, to achieve the purpose of improving the quality of life and the environment.

To achieve the object, the water curtain simulated candle lamp of the present invention, its main elements and technical means includes a base body, a cover body, a spraying device, a light source and a floating wick; wherein, a water container is set above the base body, an upper opening is set on the water container; the cover body is set on the upper opening or a relative upper position of the upper opening for covering the upper opening, and includes a concave upper surface, a spacing hole is set on a concave end of the upper surface; the spraying device includes a pump and a spray pipe, the pump is set inside the water container and a outlet is connected to an end of the spray pipe for pressurizing water into the spray pipe, an water injector is set on another end of the spray pipe, which is located in a corresponding position of the spacing hole, so that water may be sprayed upwards to form a water curtain shown outside of the cover body; the light source set on the water injector is used to light up the sprayed water curtain; the floating wick set inside the spray pipe is provided to move up and down with water flow, and an top end of the floating wick is protruded the water injector to form a wick of simulating candle lamp.

Whereby, water curtain projection effect may be achieved through water spraying and lighting by the light source, and the floating wick floats and protrudes with water flow to achieve dynamic perception of simulated fire burning. Spraying water may centralize inwards via concave upper surface of the cover body and flow back to the lower water container through the spacing hole. A complete recycling is achieved. Furthermore, suitable essence or perfume source could be added or dissolved in water to improve the environmental quality.

Preferably, a stopper portion with a smaller inner diameter set inside the spray pipe is used to stop at least a blade of the floating wick and limit the distance that the floating wick floats upwards, to thereby prevent the floating wick floating upwards to an excessive position that cannot be move downwards with water flow.

Preferably, at least a pushing piece is further set on sides of the floating wick to strengthen pushing force on the floating wick applied by water flow, so that floating motion of the floating wick may become smoother.

Preferably, at least a chute is further set on a top end of the floating wick, to centralize water sprayed out from the water injector to form water curtain simulated flame shape. Water curtain sprayed upwards may be centralized by the chute with tension or capillary forces, to achieve the effect of simulating flame shape.

Preferably, the water injector is located inside the spacing hole, a corresponding interval set between the water injector and the spacing hole is provided for spraying water curtain to flow back into the water container.

Preferably, the water injector is located inside the spacing hole, the water injector is installed on the spacing hole with a spacing collar, multiple aperture gaps set on the spacing collar are provided for spraying water curtain to flow back into the water container.

Preferably, a circuit control board is further set on the base body, and electrically connected to a power supply unit, a control switch, a light source and the pump; wherein, the power supply unit may be a built-in battery pack or an external power socket, the light source may be LED lights.

The preferred embodiment of the present invention is described as follows for relevant skilled person to further understand contents of the present invention, the technical means and achieved effect of the present invention are illustrated in details with drawings.

DETAILED DESCRIPTION OF THE INVENTION

Figure 1:
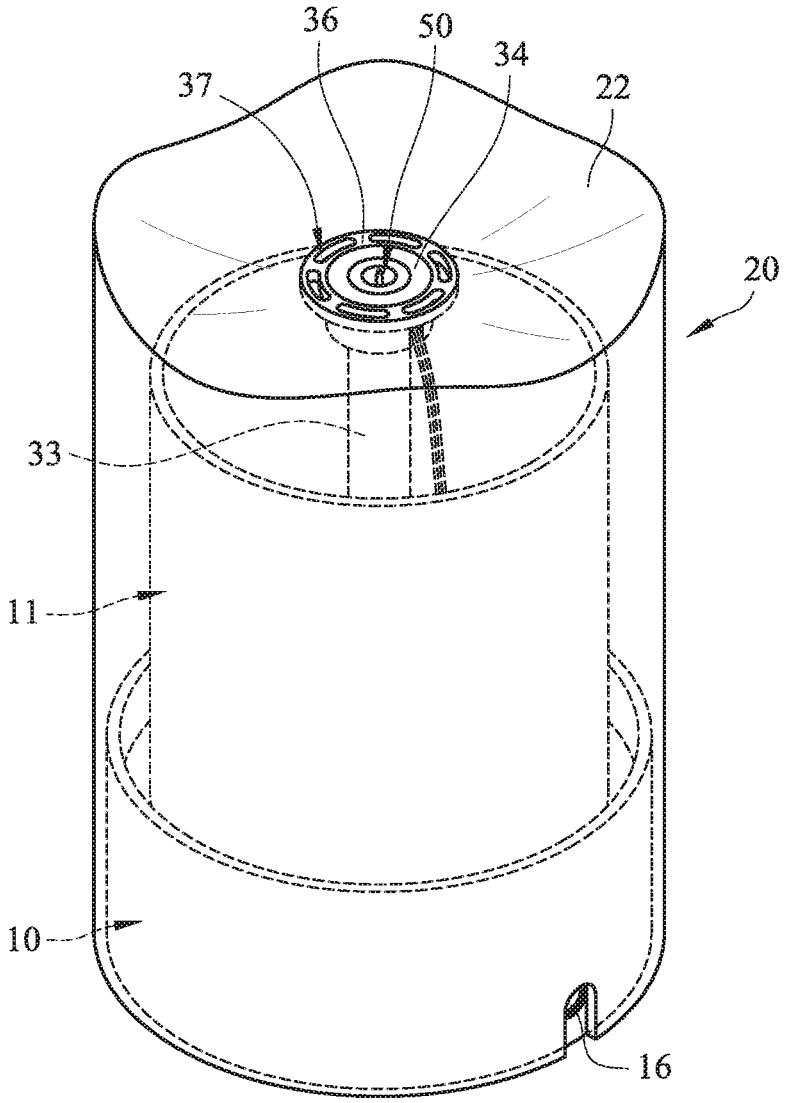
FIG. 1 is a three-dimension perspective diagram of the embodiment of the present invention.
Figure 2:
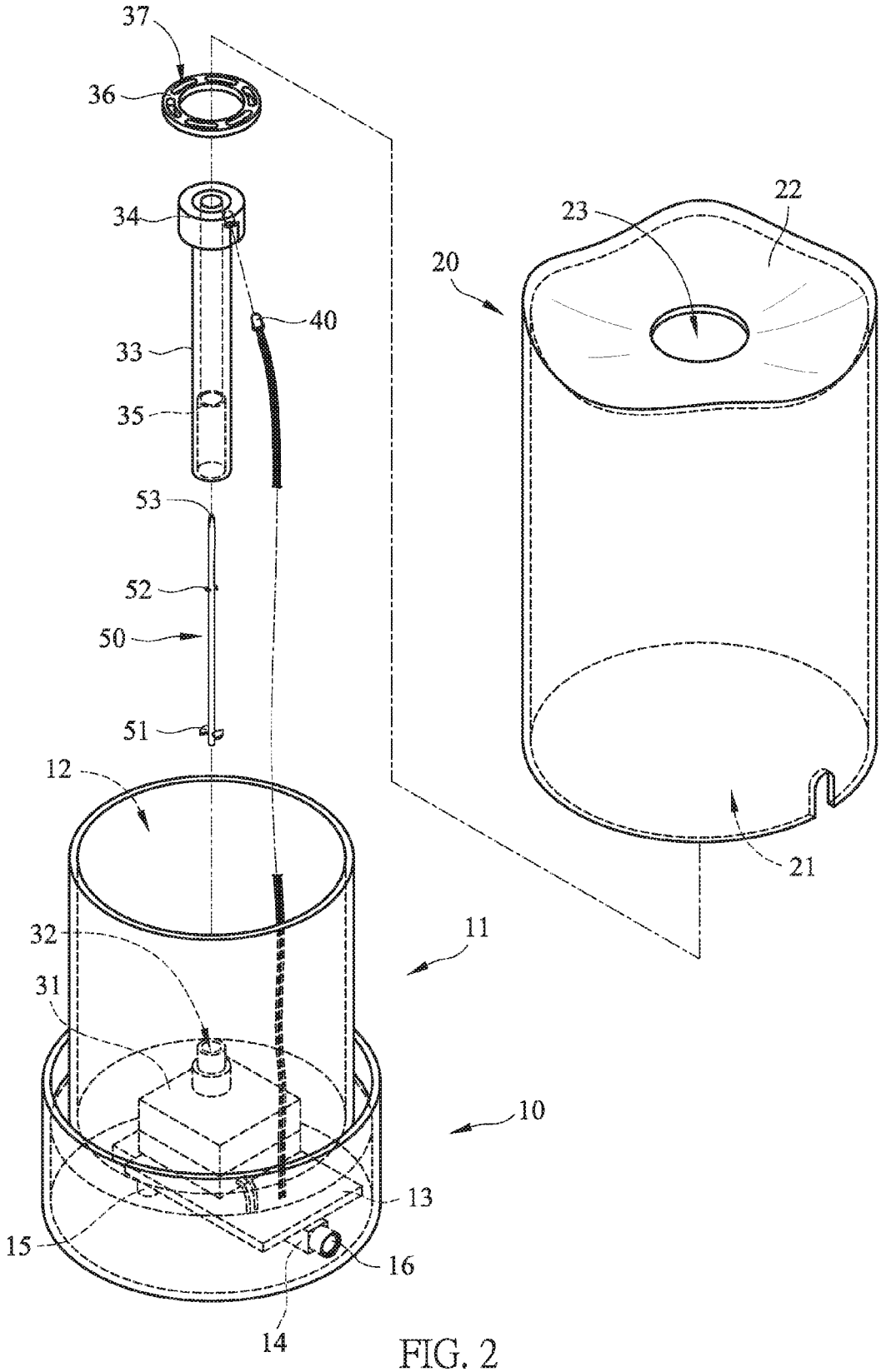
FIG. 2 is an exploded schematic diagram of elements of the embodiment of the present invention.
Figure 4:
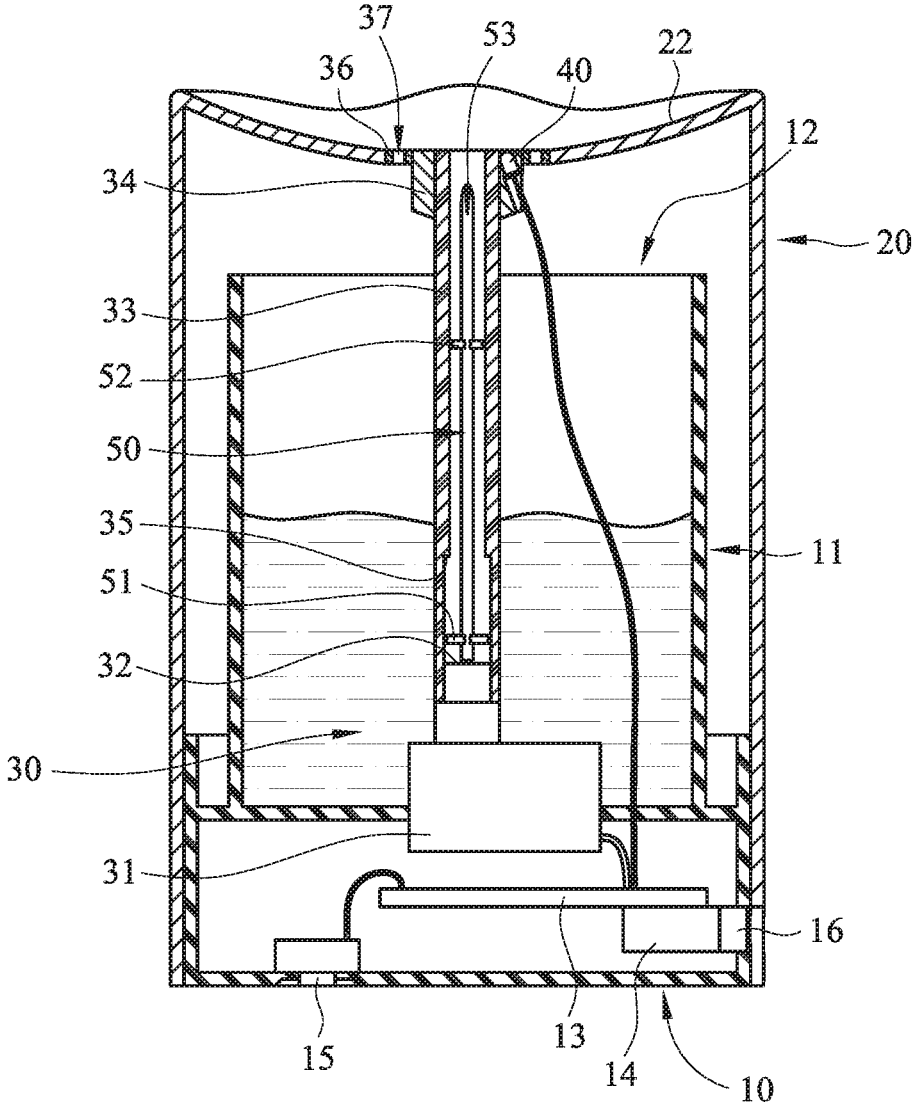
FIG. 4 is a sectional schematic diagram of an unused state of the embodiment of the present invention.

Please refer to FIG. 1, FIG. 2, and FIG. 4, the water curtain simulated candle lamp mainly includes a sear body 10, a cover body 20, a spraying device 30, a light source 40 and a floating wick 50.

A water container 11 is set on the base body 10, and is covered by the cover body 20. The cover body 20 is hollow and a lower opening 21 is set on it, it is used to cover the water container 11 and attached to the base body 10. An upper opening 12 is set on an upper edge of the water container 11, a upper surface 22 of the cover body 20 is formed relatively above, the water container 11 has an upper opening 12 on its upper edge, an upper surface 22 is formed on its relative upper position, the upper surface 22 is gradually concave toward its center, and a spacing hole 23 is set on the concave end.

The spraying device 30 is set inside the water container 11, which mainly includes a pump 31 and a spray pipe 33. The pump 31 is located on the bottom of the water container 11, and its outlet 32 is connected to an end of the spray pipe 33, so that water in the water container 11 may be pressurized to inject into the spray pipe 33. A water injector 34 with exit up is formed on another end of the spray pipe 33 and approximately located corresponding to the spacing hole 23, so that water may be sprayed upwards to form a water curtain shown outside of the cover body 20.

Figure 6:
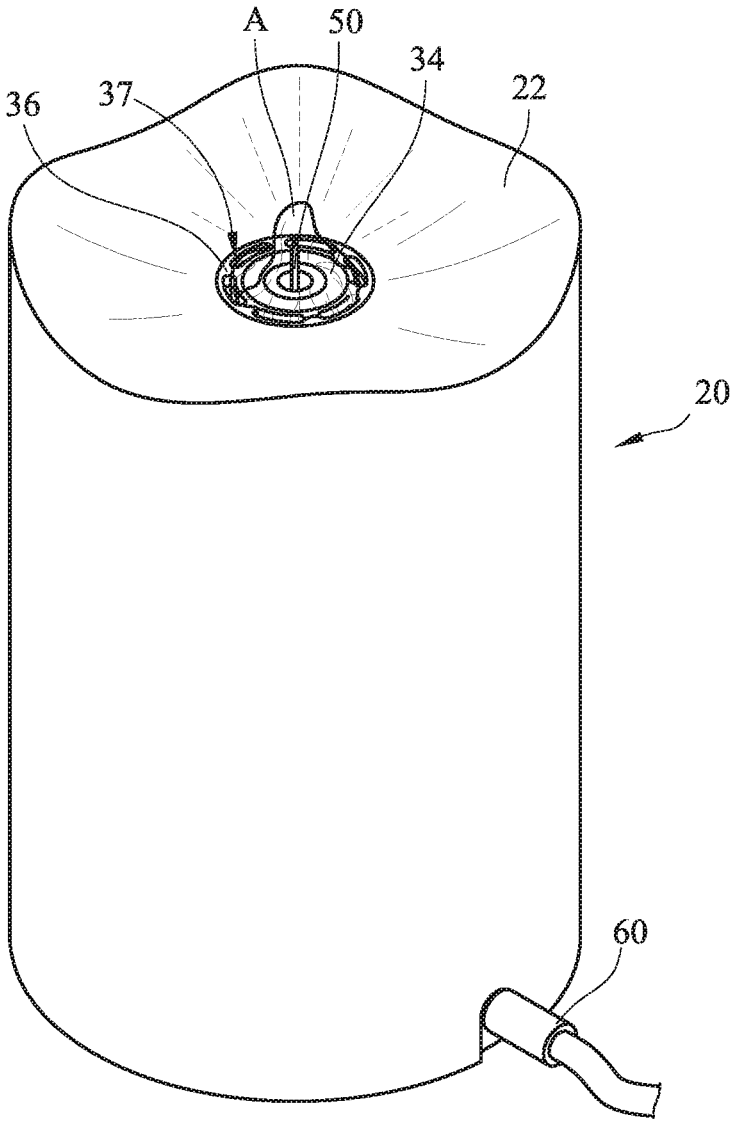
FIG. 6 is a three-dimension schematic diagram of appearance of the used state of the embodiment of the present invention.

The light source 40 is a LED, which is set on the location of the water injector 34, is provided to light up the water curtain around top of the water injector 34 to achieve a projection effect. The floating wick 50 set inside the spray pipe 33 with suitable length is provided to move up and down with water flow. The floating wick 50 moves downwards gradually and is hidden inside the spray pipe 33 when water flow stops. The floating wick 50 moves upwards with water flow when water flows upwards, its top end is protruded the water injector 34 and positioned inside the water curtain A (as shown in FIG. 6), so that it is lighted up with the water curtain A by the light source 40 to achieve dynamic perception of simulated candle lamp and candle wick.

In implemented embodiment, the style of the base body 10, the water container 11 and the cover body 20 may be set according to demands, the cover body 20 is mainly provided to cover the upper opening 12 of the water container 11 and located on its relative upper location, thus, the cover body 20 may be designed attaching to the upper opening 12. It should be understood first that the shape disclosed in the embodiment of the present invention is not intended to limit the present invention.

Figure 3A:
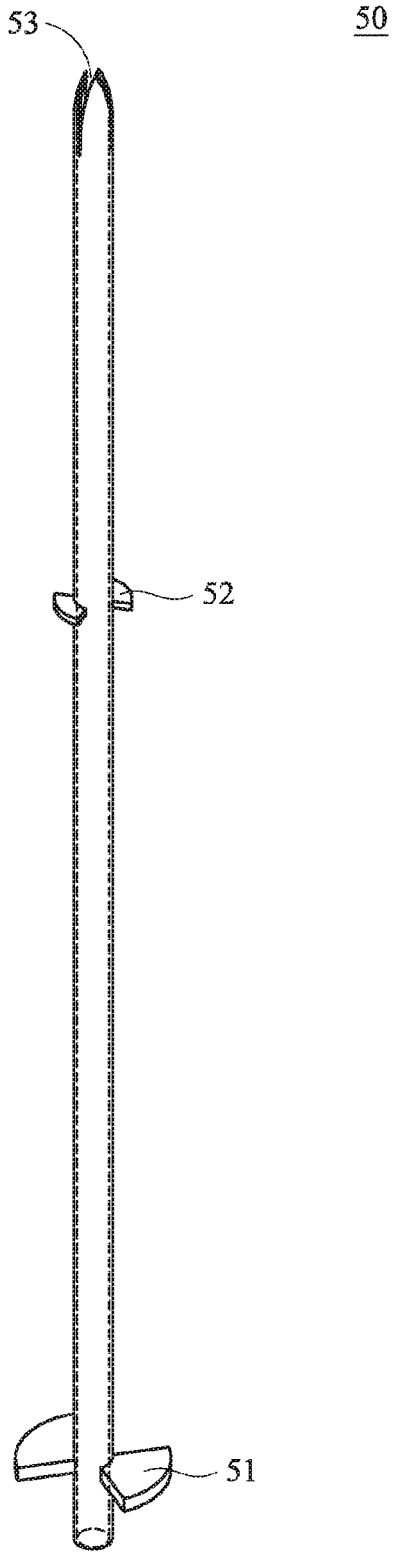
FIG. 3A is a structure diagram of the floating wick of the embodiment of the present invention.

In the embodiment, the spray pipe 33 is set in a central position of the water container 11 vertically, a lower section with larger inner diameter and a mid-upper section with smaller inner diameter, a stopper portion 35 is formed in the position that the inner diameter changing. For the floating wick 50 set inside the spray pipe 33, please also refer to FIG. 3A, blades 51 set in lower end is provided to be stopped by the stopper portion 35, to thereby limit the distance that the floating wick 50 floats upwards, to avoid the floating wick 50 escaping from a predetermined position with water flow. Furthermore, an appropriate number of pushing pieces 52 may be set on sides of the floating wick 50 according to demands, to strengthen pushing force on the floating wick 50 applied by water flow without affecting its motion. A chute is set on a top end of the floating wick 50, to centralize water sprayed out from the water injector 34 to form water curtain A simulated flame shape.

Figure 3B:
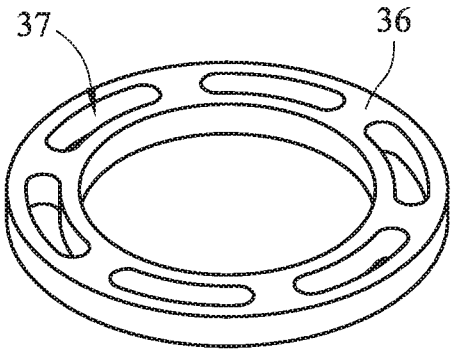
FIG. 3B is a structure schematic diagram of the spacing collar of the embodiment of the present invention.

Please also refer to FIG. 3B, a spacing collar 36 is circumferentially set on the water injector 34 of the spray pipe 33 for installing on the spacing hole 23 of the cover body 20, to thereby achieve the relative positioning effect. Multiple aperture gaps 37 set on the spacing collar 36 are provided for spraying water curtain A to flow back into the water container 11 via aperture gaps 37. In implemented embodiments, a corresponding interval is set between the water injector 34 and the spacing hole 23 to replace the spacing collar 36 and the aperture gaps 37 that water may flow back into the water container 11 via aperture gaps 37.

Other related electrical elements, such as the circuit control board 13, the power supply unit 14, the control switch 15, may be installed in the base body 10 unlimitedly. Wherein, the circuit control board 13 is electrically connected to the power supply unit 14, the control switch 15, the light source 40 and the pump 31 respectively, operating state of all the electrical elements may be modulated by switch signals of the control switch 15. The power supply unit 14 may be a built-in battery pack, such as dry battery and lithium battery, or an external power socket 16 for the external power source 60 to be powered or charged (as shown in FIG. 6).

Figure 5:
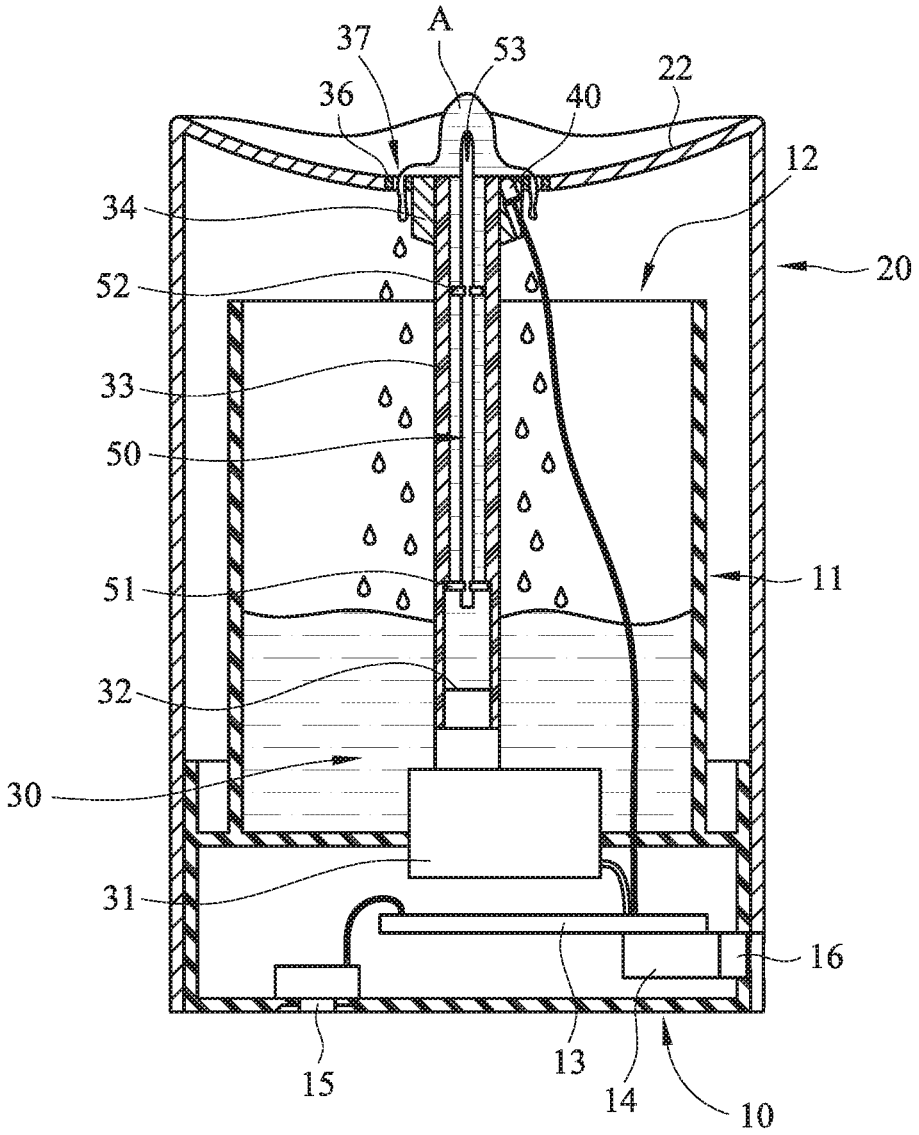
FIG. 5 is a sectional schematic diagram of an used state of the embodiment of the present invention.

Please also refer to FIG. 4 to FIG. 6, in actual use of the present invention, a user may open the cover body 20 first and add appropriated water in the water container 11 and put the cover body 20 back. As shown in FIG. 4, the floating wick 50 is naturally located under the spray pipe 33 when not start, the whole body is hidden inside the spray pipe 33. When the user starts, as shown in FIG. 5, the pump 31 starts injecting water into the spray pipe 33, the floating wick 50 moves upwards with rising water flow and its top end is protruded the water injector 34, water is sprayed out from the water injector 34 and centralize inwards via the chute 53 on the top of the floating wick 50, the water curtain A with a shape like flame is formed before falling down, the light source 40 simultaneously lights it up to achieve dynamic perception of simulated candle lamp and candle wick.

Above all, the architecture of the present invention is innovative and may be applied to a wide range, so that the present invention conforms to requirements for patent applications, and the inventor submitted application in accordance with law assistance. The embodiments disclosed in the present invention are only used to give examples of the present invention and illustrate features of the present invention, is not intended to limit the scope of the present invention. The specific scope of rights should be subject to claims, any change that any person skilled in the art can easily complete or uniformity of the arrangements are within the scope of the claims of the present invention.

What is claimed is:

1. A water spray simulated candle lamp, including:

a base body including a water container with an upper opening therein;

a cover body disposed over the base body to cover the upper opening, and having a concave upper surface and a spacing hole formed in a concave end portion of the concave upper surface;

a spraying device, which includes a pump and a spray pipe, the pump disposed inside the water container, an outlet of the pump connected to one end of the spray pipe for pressurizing water to be injected into the spray pipe, and the other end of the spray pipe defining a water injector, which is located in a corresponding position of the spacing hole for spraying water upwards to form a shape of a flame above the cover body;

a light source disposed on the water injector for lighting up the sprayed water; and a floating wick disposed inside the spray pipe so as to move up and down by the flowing water, and a top end of the floating wick protruding from the water injector to simulate a wick of a burning candle.

2. The water spray simulated candle lamp as claimed in claim 1, further comprising a stopper portion with an inner diameter, disposed inside the spray pipe for stopping at least one blade of the floating wick and limiting the distance that the floating wick floats upwards.

3. The water spray simulated candle lamp as claimed in claim 2, further comprising at least one pushing piece disposed on sides of the floating wick to strengthen a pushing force on the floating wick applied by the flowing water.

4. The water spray simulated candle lamp as claimed in claim 2, wherein at least one chute is formed on a top end of the floating wick, to centralize the water sprayed out from the water injector to form the sprayed water in a flame shape that simulates a flame.

5. The water spray simulated candle lamp as claimed in claim 4, wherein the water injector is located inside the spacing hole, and a corresponding interval is provided between the water injector and the spacing hole for causing the sprayed water to flow back into the water container.

6. The water spray simulated candle lamp as claimed in claim 4, further comprising a spacing collar, wherein the water injector and the spacing collar are located inside the spacing hole, and a plurality of aperture gaps are formed in the spacing collar for causing the sprayed water to flow back into the water container.

7. The water spray simulated candle lamp as claimed in claim 6, further comprising a circuit control board disposed in the base body, and configured for electrical connection to a power supply unit, a control switch, a light source and the pump.

8. The water spray simulated candle lamp as claimed in claim 3, wherein at least one chute is formed on a top end of the floating wick, to centralize the water sprayed out from the water injector to form the sprayed water in a flame shape that simulates a flame.

9. The water spray simulated candle lamp as claimed in claim 8, wherein the water injector is located inside the spacing hole, and a corresponding interval is provided between the water injector and the spacing hole for causing the sprayed water to flow back into the water container.

10. The water spray simulated candle lamp as claimed in claim 8, further comprising a spacing collar, wherein the water injector and the spacing collar are located inside the spacing hole, and a plurality of aperture gaps are formed in the spacing collar for causing the sprayed water to flow back into the water container.

11. The water spray simulated candle lamp as claimed in claim 10, further comprising a circuit control board disposed in the base body, and configured for electrical connection to a power supply unit, a control switch, a light source and the pump.

* * * * *